United States Patent [19]

Beaver

[11] Patent Number: 4,894,128

[45] Date of Patent: Jan. 16, 1990

[54] MEMBRANE UNIT FOR ELECTROLYTIC CELL

[75] Inventor: Richard N. Beaver, Angleton, Tex.

[73] Assignee: The Dow Chemical Company, Midland, Mich.

[21] Appl. No.: 860,703

[22] Filed: May 5, 1986

[51] Int. Cl.[4] ..... C25B 1/16; C25B 1/24; C25B 9/00

[52] U.S. Cl. ..... 204/98; 204/128; 204/252; 204/253; 204/296

[58] Field of Search ..... 204/98, 128, 253, 296

[56] References Cited

U.S. PATENT DOCUMENTS

| | | | |
|---|---|---|---|
| 2,867,575 | 1/1959 | De Jong | 204/296 |
| 4,175,024 | 11/1979 | Darlington | 204/283 |
| 4,191,627 | 3/1980 | Specht | 204/283 |
| 4,197,206 | 4/1980 | Kurn | 204/253 |
| 4,217,200 | 8/1980 | Kedem et al. | 204/296 |
| 4,219,394 | 8/1980 | Babinsky et al. | 204/296 |
| 4,253,932 | 3/1981 | Mose et al. | 204/253 |
| 4,268,372 | 5/1981 | Iizima et al. | 204/252 |
| 4,268,373 | 5/1981 | Iijima et al. | 204/252 |
| 4,274,928 | 6/1981 | Cunningham | 204/98 |
| 4,316,790 | 2/1982 | Iijima et al. | 204/282 |
| 4,332,661 | 6/1982 | Ford et al. | 204/252 |
| 4,341,605 | 4/1982 | Solenberger et al. | 204/98 |
| 4,344,633 | 8/1981 | Niksa | 277/228 |
| 4,368,108 | 1/1983 | Ford | 204/253 |
| 4,431,502 | 2/1984 | Ford | 204/252 |
| 4,441,977 | 4/1984 | Ford | 104/252 |

FOREIGN PATENT DOCUMENTS

| | | |
|---|---|---|
| 0051380 | 5/1982 | European Pat. Off. . |
| 2821983 | 11/1979 | Fed. Rep. of Germany . |
| 146272 | 12/1978 | Japan . |
| 0038484 | 4/1981 | Japan . |
| 0004926 | 1/1983 | Japan . |
| 58-35272 | 8/1983 | Japan . |
| 1192245 | 5/1970 | United Kingdom . |
| 2013242 | 8/1979 | United Kingdom . |

*Primary Examiner*—John F. Niebling
*Assistant Examiner*—Kathryn Gorgos

[57] ABSTRACT

A membrane unit for use in an electrolytic cell comprising a combination of a membrane material and a reinforcing material around only the gasket-bearing surface of the membrane material. Damage to the gasket bearing surface of the membrane structure is minimized when the membrane unit is employed in, for example, electrolytic cells of the filter press-type.

23 Claims, 2 Drawing Sheets

MEMBRANE UNIT FOR ELECTROLYTIC CELL

CROSS-REFERENCE TO RELATED APPLICATION

This is a continuation of application Ser. No. 668,043 filed Nov. 5, 1984, now abandoned.

BACKGROUND OF THE INVENTION

This invention relates to membranes and, more particularly, this invention relates to a membrane unit for use in electrolytic cells.

There are many well-known membranes for use in electrolytic cells. For example, typical membranes include the perfluorinated carboxylic or sulfonic cation exchange membranes such as Nafion® manufactured by E. I. duPont de Nemours and Company or Flemion® manufactured by Asahi Glass Company, Ltd. These membranes are typically available in sheet form and employed in filter press-type or flat plate-type electrolytic cells having monopolar or bipolar electrodes. Examples of bipolar, filter press-type cells are described in U.S. Pat. Nos. 4,111,779 and 4,108,742. These cells are used, for example, to carry out electrolysis of an aqueous alkali metal halide to produce a halogen, for example chlorine, and an alkali metal hydroxide such as sodium hydroxide. Generally, the bipolar, filter press-type electrolytic cell is composed of several bipolar unit cells arranged in series. One bipolar unit cell has an anode and cathode compartment separated by a partition wall. Typically, the anode and cathode are attached to opposite sides of the partition wall. The membrane is usually interposed between two adjacent unit cells to separate the anode compartment from the cathode compartment. A plurality of anode and cathode frames are installed in a parallel fashion and a longitudinal compressive, usually by a clamping means, is applied to the anode and cathode frames with the membrane interposed between the frames to form the electrolytic cell in toto.

It is common practice to interpose a gasket between the membrane and the anode or cathode frame to provide the electrolytic cell with fluid-tight, i.e., a liquid- and gas-tight seal to prevent leakage of electrolyte between anode and cathode compartments or to the atmosphere. It is important to have a complete liquid- and gas-tight seal in electrolytic cells because these cells typically operate under corrosive environments. Generally, one side of the gasket is in contact with the lateral face of an electrode frame and the other side of the gasket is in contact with one side of the membrane's peripheral surface.

Typical gasket materials include resilient material such as rubber or an elastomer. Commercial bipolar membrane electrolyzers generally use ethylene-propylene (EPM) or ethylene-propylene-diene (EPDM) as gasket material between the membrane and electrode frames. These materials tend to deform and expand outwardly as pressure is applied to the frames via the frame members. As the gaskets deform outwardly, certain membranes which are in contact with the gaskets tend to stretch when they are pulled under the pressure of the outwardly deforming gaskets. This stretching of the membrane beneath the gaskets employed on adjacent electrode frames can cause the membranes to break or tear when attempting to compress the frames into a fluid-tight cell. In addition, resilient gaskets require a high compressive force to effect a seal which increases the risk of breaking or tearing the membrane.

Any tears or breaks in the membranes may reduce current efficiency during operation, greatly increasing electrical current usage while reducing the electrolytic operating efficiency of the cell. Too great a drop in current efficiency and/or electrolytic operating efficiency can require costly shutdown of the entire cell while the damaged membrane or membranes are replaced.

It is desired to provide a membrane unit which will resist tearing upon application of a compressive force to the membranes gasket bearing surface.

SUMMARY OF THE INVENTION

The present invention is an ion exchange membrane unit comprising at least one layer of a first material adapted for use as an ion exchange membrane and at least one layer of a second material adapted to reinforce the membrane. The reinforcing layer is secured to at least one side of the membrane around a gasket-bearing surface of the membrane.

BRIEF DESCRIPTION OF THE DRAWINGS

Although alternative embodiments of the present invention are shown in the following Figures, the same numerical system is used in the drawings to describe identical elements.

DETAILED DESCRIPTION OF THE PREFERRED EMBODIMENTS

Figure 1:
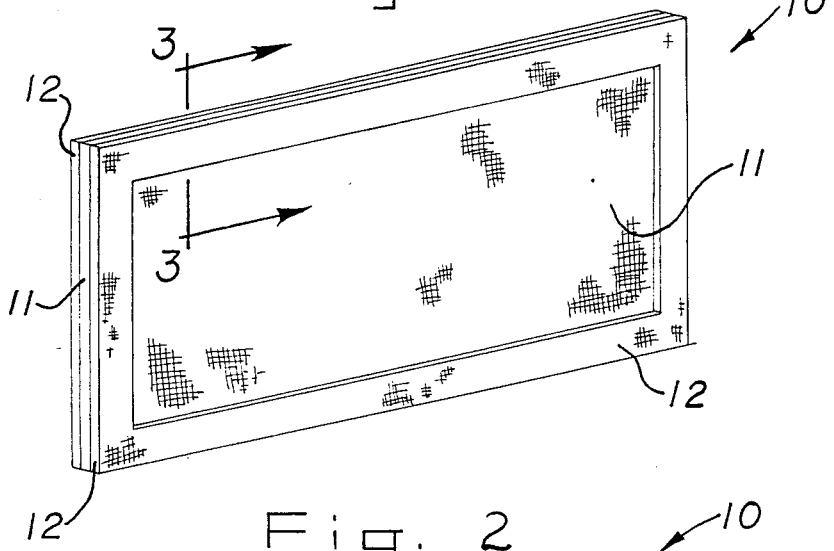
FIG. 1 is a perspective view of the membrane unit of the present invention showing a sheet of membrane material having a reinforcement material along the periphery.

The invention will now be described in conjunction with an embodiment thereof with reference to the accompanying drawings. Referring to FIGS. 1–6, a rectangular sheet 11 made of a membrane material with a layer of reinforcing material 12 is attached, bonded or otherwise adhered to at least a portion of the gasket-bearing surface of the membrane materials. FIG. 3 shows reinforcing material 12 secured to both sides of the membrane 11 and only along the gasket-bearing surface of membrane 11. While FIG. 4 shows only one planar surface of the membrane 11 with reinforcing material 12 and only along the gasket-bearing surface of membrane 11. "Gasket-bearing surface" is defined as that portion of the periphery of the membrane material subjected to compression forces in order to effect a seal at the periphery of an electrode frame of an electrolyzer. In FIG. 1, the reinforcement material 12 has a picture-frame shape, however, it is to be understood that the membrane unit or structure of this invention is not limited to a rectangular sheet but can be circular or other desired shape.

The membrane material 11 can be made of any material used as a membrane for electrolyzers. Preferably, inert membranes having ion exchange properties and which are substantially impervious to the hydrodynamic flow of the electrolyte and the passage of gas products produced during electrolysis are used. Suitably used are cation exchange membranes such as those composed of fluorocarbon polymers having a plurality of pendant sulfonic acid groups or carboxylic acid groups or mixtures of sulfonic acid groups and carboxylic acid groups. The terms "sulfonic acid groups" and "carboxylic acid groups" are meant to include salts of sulfonic acid or salts of carboxylic acid which are suitably converted to or from the acid group by processes such as hydrolysis. An example of a carboxylic acid type cation exchange membrane is commercially available from Asahi Glass Company under the trademark Flemion®. Another example of a suitable membrane having cation exchange properties is a perfluorosulfonic acid membrane sold commercially by E. I. duPont de Nemours and Company under the trademark Nafion®.

The reinforcing material 12 can be made of any material suitable for strengthening the gasket bearing surface area of the membrane. The reinforcing material 12 can be of the same or different material as the membrane material 11. Preferably the reinforcing material 12 should have a heavier scrim than that of the membrane material. Both the membrane material 11 and the reinforcing material 12 should be made of a corrosion-resistant, non-contaminating material which is stable upon contact with electrolyte media present in an electrolytic cell. Suitable materials which can be employed in accordance with this invention include, but are not limited to, the following: fluorine-containing polymers such as polytetrafluoroethylene (PTFE), fluorinated ethylene propylene copolymer (FEP) and perfluoroalkoxy resin (PFA); polysulfide polymers, polyvinyl chloride, fluoroelastomers such as Viton®, a trademark of E. I. duPont de Nemours and Company, and chlorosulfonated polyethylenes such as Hypalon®, a trademark of E. I. duPont de Nemours and Company.

The reinforcing material 12 can be attached or otherwise secured to the membrane 11 by any well known method in the art, for example, bonding with an adhesive, heat sealing, or ultrasonic sealing. It is preferred to heat seal the reinforcing material to the membrane.

Figure 2:
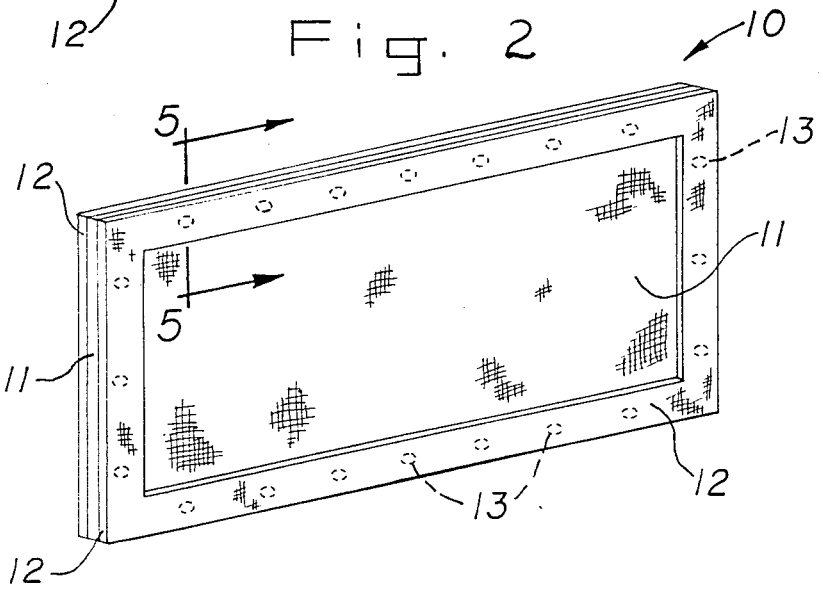
FIG. 2 is a perspective view of another embodiment of the present invention showing a membrane material having a plurality of opening and reinforcing material along the periphery.
Figures 3, 4, 5:
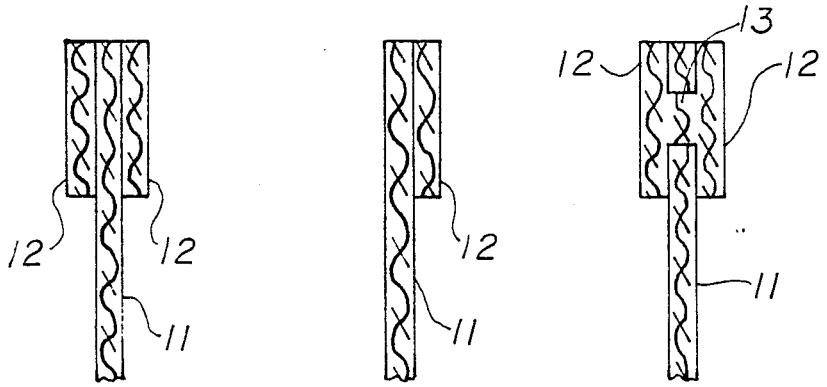
FIG. 3 is a cross-sectional view taken along line 3—3 of FIG. 1.
FIG. 4 is a cross-sectional view of an alternate embodiment of the present invention showing a sheet of membrane material having a reinforcement material on a single planar surface.
FIG. 5 is a cross-sectional view taken along line 5—5 of FIG. 2.

In FIGS. 2 and 5, a membrane material 11 contains perforations or openings 13 along its periphery or gasket-bearing surface. A reinforcing material 12 is secured to the gasket bearing surface and layers the openings 13 on both sides of the membrane 11. A membrane material having openings 13 such as shown in FIGS. 2 and 5 allows for the reinforcing material 12 to bond through the membrane material 11 to the reinforcing material 12 on the opposite side through the openings 13. This is useful when bonding reinforcing material which is substantially difficult to attach to the membrane material. Generally, when the reinforcing material and the membrane material are made of dissimilar materials, the opening 13 should be used.

Figure 6:
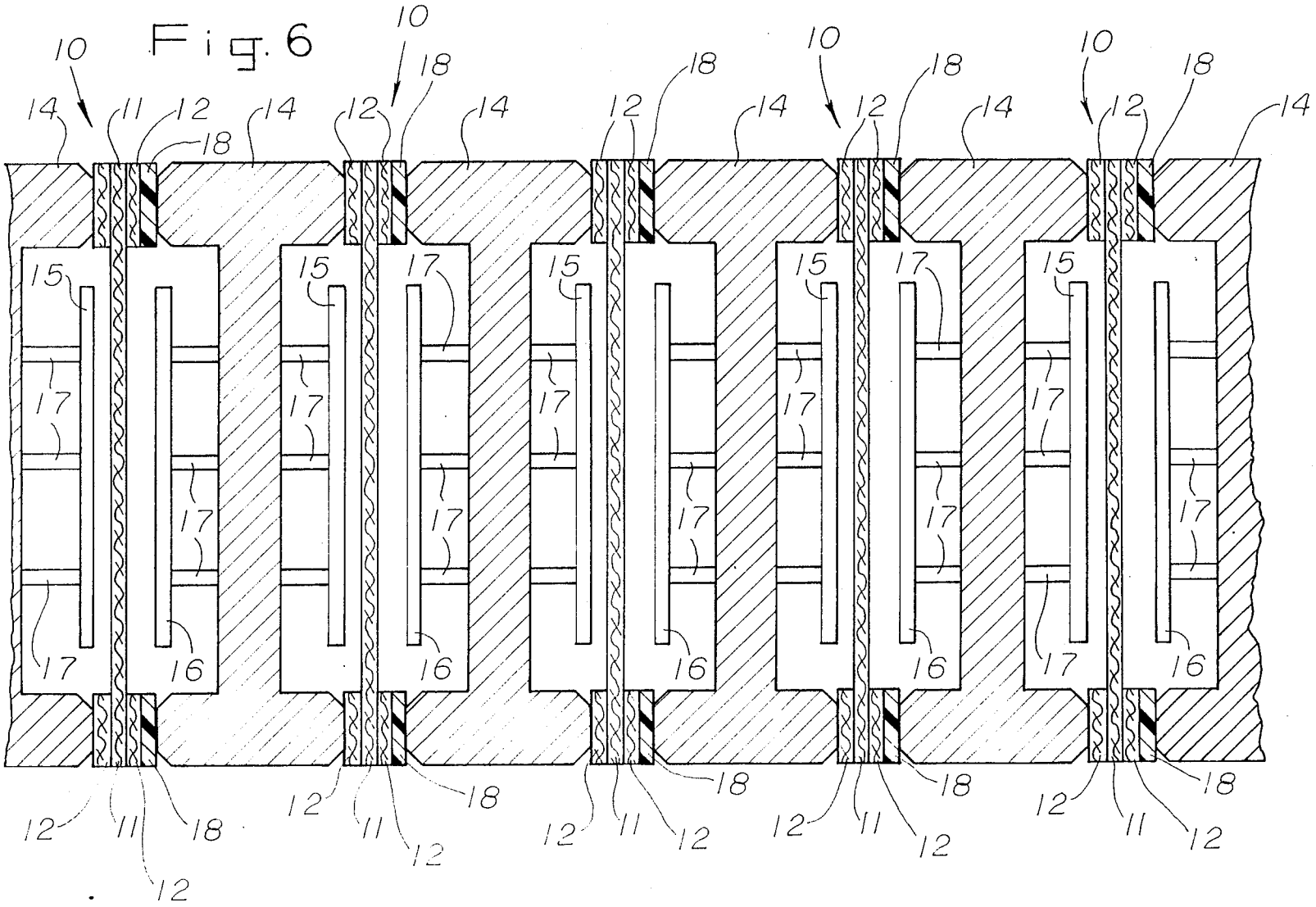
FIG. 6 is a sectional view showing a portion of an electrolytic cell series assembly including the membrane unit shown in FIG. 1 in accordance with the present invention.

Referring to FIG. 6, an electrolysis cell assembly is shown wherein a membrane unit generally designated as numeral 10, comprising a membrane material 11 and a reinforcing material 12 attached to both sides of the membrane material 11, is interposed between two electrode frame units 14. A gasket 18 may be interposed between the membrane unit 10 and an electrode frame 14. It is also within the scope of the invention to interpose a gasket 18 on both sides of the membrane structure 10 and two adjacent electrode frames 14. Any gasket used in electrolysis cell of the filter press type may be used. The gasket should be of a corrosion resistant material. The gasket should have a high volume resistivity and good sealability after it has been compressed. Suitable materials for the gasket 14 may be, for example, EPDM, a chlorinated polyethylene (CPE), a polytetrafluoroethylene such as Teflon®, manufactured by E. I. duPont de Nemours and Company, and reinforced asbestos. An anode 15 and a cathode 16 are electrically connected with connectors 17 through the electrode frame 14. The electrolysis assembly above is typical of bipolar electrolytic cells of the filter press type such as described in U.S. Pat. Nos. 4,111,779 and 4,108,742. Any cell of the filter press type may be used in the present invention.

In order to effect sealing of the periphery of the electrode frame 14, the membrane structure 10 and a gasket 18 are interposed between two adjacent electrode frames 14 and then a compressive force is applied to the cell assembly. The compressive force may be applied by any known means to those skilled in the art, for example, by clamping the frames together or by using a hydraulic ram. Preferably a hydraulic ram is used to squeeze the electrode frames, gaskets and membranes together. The actual compressive force applied will be dictated by the type of material used for the gasket.

The invention will be illustrated further in the examples which follow.

EXAMPLE 1

A 4 inch by 4 inch test sample of Nafion® 901 membrane, obtained from the duPont Company of Wilmington, Delaware, was reinforced by heat sealing strips of PFA fluoroplastic film around the edges on both sides of the membrane. Any heat-sealing technique known in the art may be used. In this instance, the heat sealing was performed by the EGC Corporation of Houston, Texas, under contract to The Dow Chemical Company. The film thickness used on the cathode side of the membrane was 15 mils thick while the film thickness used on the anode side of the membrane was 5 mils thick. The design used is indicated in FIGS. 1 and 3.

A laboratory electrolytic cell was used for testing the test samples. The cell consisted of an anode compartment half and a cathode compartment half. The anode compartment half was made of titanium having the titanium surface located under the gasket area half of the coated with a ruthenium dioxide coating to avoid possible crevice corrosion problems. The cathode compartment half of the cell was made of acrylic. The anode was made of titanium with a ruthenium dioxide coating and the cathode was a nickel cathode.

The gasket used was a 1/16 inch thick gasket made of EPDM rubber purchased from the Prince Rubber & Plastics Co., Inc. of Buffalo, N.Y. The gaskets were cut from single EPDM rubber sheets to form a picture-frame shape with dimensions of $3\frac{3}{4}$ inches outside-to-outside and 3 inches inside-to-inside. Thus, the width of the gasket surface was $\frac{3}{8}$ inch. The total gasket area was 5.0625 square inches. The gasket was used on both sides of the membrane and contact loading was distributed over the reinforced surface.

Ten ⅜ inch diameter bolts were torqued to 12 ft-lbs force to press together the anode and cathode compartments, the membrane and gaskets resulting in a total force of 19,000 pounds from the bolt loading. The force exerted on the membrane under the gaskets was equivalent to 3750 psi. The force used on this test sample was ten times greater than the force used on the test sample described in the Comparative Example A, below.

The cell of this example was operated to produce 32 weight percent caustic while controlling the anolyte salt at 200 grams per liter sodium chloride concentration. The cell temperature was maintained at 90° C. with ampere loading controlled at 2 amperes per square inch of projected anode area current density. The test was conducted for 210 days and during this period the caustic current efficiency averaged 95 percent with an average cell voltage of 3.5. The cell operated without leaks and performed without complications.

Visual inspection of the membrane after dismantling the cell showed the membrane to be in excellent condition with no tears or breaks in the gasket contact and loading area. Thus, the reinforcing concept of the invention protected the membrane from damage and showed a successful improvement over the membrane used in the Comparative Example A, below.

COMPARATIVE EXAMPLE A

A 98 inch by 50 inch test sample of Nafion® 324 membrane, obtained from the duPont Company of Wilmington, Del. was used in this test. The gasket surfaces of the membrane were not reinforced.

The electrolytic cell used in this test is described in U.S. patent application Ser. No. 472,792, filed Mar. 7, 1983, and is of a type well known in the industry as a bipolar flat plate-type cell having a nominal size of 4 feet by 10 feet. The cell contained an anode of titanium with a ruthenium oxide coating and a cathode of steel.

The gasket used was a 3/16 inch thick gasket made of EPDM rubber purchased from the Prince Rubber and Plastics Co., Inc., of Buffalo, N.Y. Specifications for the EPDM include "EPDM for Chlor-Alkali Service, Prince #6962." The gaskets were cut from single EPDM rubber sheets to form a picture-frame shape with dimensions of 97¼ inches outside-to-outside and 93¼ inches inside-to-inside in the long direction and 49¼ inches outside-to-outside and 45¼ inches inside-to-inside in the short direction. Thus, the width of the gasket surface was 2 inches. The total gasket area was 570 square inches. The gasket was used on both sides of the membrane and contact loading was distributed over the reinforced surface.

A hydraulic cylinder in a filter press arrangement was used to press together the cell units. The total force resulting from the action of the hydraulic press was 172,140 pounds. The force exerted on the membrane was equivalent to 302 psi.

The cells were operated to produce about 12 to 16 weight percent caustic while controlling the anolyte salt at 200 grams per liter sodium chloride concentration. The cell temperature was maintained at 90° C. with D.C. current controlled at 10.0 kiloamperes. Thus, the ampere loading was 2 amperes per square inch of projected anode area current density. The test was conducted for 199 days and during this period, the caustic current efficiency averaged 82–84 percent which was 4 percent below the expected caustic current efficiency for Nafion® 324.

Visual inspection of the membrane after dismantling the cell showed the membrane to have severe damage in the areas beneath the gaskets and in the area next to the gaskets. The gasket loading forces had stretched and cracked the membrane so severely to render the overall cell performance unsatisfactory.

What is claimed is:

1. An ion exchange membrane unit adapted for electrolyzers of the filter press type having at least one anode frame member and at least one cathode frame member, said electrolyzer adapted for producing an alkali metal hydroxide and a halogen by electrolysis of an alkali metal halide, comprising:

(a) at least one sheet of a hydraulically impermeable cation exchange membrane comprised of fluorocarbon polymers having a plurality of pendant groups selected from the group consisting of sulfonic acid groups, carboxylic acid groups, and mixtures thereof, said membrane material adapted for producing an alkali metal hydroxide and a halogen by electrolysis of an alkali metal halide, said ion exchange membrane having a gasket-bearing surface portion and an active surface portion; and (b) at least one non-gasket, non-supporting frame reinforcement means for strengthening the gasket-bearing surface portion of the membrane such that tearing or shear stresses on the gasket-bearing surface portion of the membrane is minimized when the gasket-bearing surface portion of the membrane is under a compressive force, said reinforcement means positioned only along the gasket-bearing surface portion of the membrane on at least one side of the membrane.

2. The membrane unit of claim 1 wherein the chemical composition of the reinforcing material is of the same chemical composition as the membrane material.

3. The membrane unit of claim 1 wherein the membrane material is composed of fluorocarbon polymers having a plurality of pendant sulfonic acid groups, carboxylic acid groups or mixtures of sulfonic acid groups and carboxylic acid groups.

4. The membrane unit of claim 1 wherein the reinforcing material is secured to the membrane material by a heat sealing process.

5. The membrane unit of claim 1 wherein the reinforcing material is attached to the membrane material with an adhesive.

6. The membrane unit of claim 1 wherein the membrane material has at least one opening through the gasket-bearing surface of the membrane material and the reinforcing material is secured to the membrane material by heat sealing the reinforcing material to itself through the opening.

7. The membrane unit of claim 1 wherein the reinforcing material is about 0.003 inch to about 0.020 inch thick.

8. The membrane unit of claim 1 wherein the reinforcing material is a tetrafluoroethylene fluorocarbon polymer material.

9. The membrane unit of claim 1 wherein the reinforcing material has a heavier scrim than that of the membrane material.

10. An electrolytic cell assembly of the filter press type adapted for producing an alkali metal hydroxide and a halogen by electrolysis of an alkali metal halide comprising:

(a) at least two electrode frame members, (b) at least one membrane unit interposed between the two adjacent electrode frame members separating at least two electrode compartments, and (c) at least one gasket interposed between the membrane unit and one electrode frame member, said membrane unit comprising at least one sheet of a hydraulically impermeable cation exchange membrane comprised of fluorocarbon polymers having a plurality of pendant groups selected from the group consisting of sulfonic acid groups, carboxylic acid groups, and mixtures thereof, said membrane material adapted for producing an alkali metal hydroxide and a halogen by electrolysis of an alkali metal halide, said ion exchange membrane having a gasket-bearing surface portion and an active surface portion; and at least one non-gasket, non-supporting frame reinforcement means for strengthening the gasket-bearing surface portion of the membrane such that tearing or shear stresses on the gasket-bearing surface portion of the membrane is minimized when the gasket-bearing surface portion of the membrane is under a compressive force, said reinforcement means positioned only along the gasket-bearing surface portion of the membrane on at least one side of the membrane.

11. The cell of claim 10 wherein the chemical composition of the reinforcing material is of the same chemical composition as the membrane material.

12. The cell assembly of claim 10 wherein the reinforcing material is attached to the membrane material by a heat sealing process.

13. The cell assembly of claim 10 wherein the reinforcing material is attached to the membrane material with an adhesive.

14. The cell assembly of claim 10 wherein the membrane material has at least one opening through the gasket-bearing surface of the membrane material and the reinforcing material is secured to the membrane material by heat sealing the reinforcing material to itself through the opening.

15. The cell assembly of claim 10 wherein the reinforcing material is about 0.003 inch to about 0.020 inch thick.

16. The cell assembly of claim 10 wherein the reinforcing material is a tetrafluoroethylene fluorocarbon polymer material.

17. The cell assembly of claim 10 wherein the reinforcing material has a heavier scrim than that of the membrane material.

18. A method of sealing an electrolytic cell adapted for producing an alkali metal hydroxide and a halogen by electrolysis of an alkali metal halide comprising:

(a) interposing at least one membrane unit between at least two adjacent electrode frame members of the electrolytic cell;

(b) interposing at least one gasket member between at least one electrode frame member and a membrane unit of the electrolytic cell, said membrane unit comprising at least one sheet of a hydraulically impermeable cation exchange membrane comprised of fluorocarbon polymers having a plurality of pendant groups selected from the group consisting of sulfonic acid groups, carboxylic acid groups, and mixtures thereof, said membrane material adapted for producing an alkali metal hydroxide and a halogen by electrolysis of an alkali metal halide, and at least one non-gasket, non-supporting frame reinforcement means for strengthening the gasket-bearing surface portion of the membrane such that tearing or shear stresses on the gasket-bearing surface portion of the membrane is minimized when the gasket-bearing surface portion of the membrane is under a compressive force, said reinforcement means positioned only along the gasket-bearing surface portion of the membrane on at least one side of the membrane; and (c) applying a compressive force to the electrolytic cell via the electrode frame members.

19. A method of electrolyzing an alkali metal salt to form an alkali metal hydroxide and a halogen comprising:

(a) interposing at least one membrane unit between at least a cathode frame member having a cathode and at least an anode frame member having an anode forming a catholyte and anolyte compartment;

(b) interposing at least one gasket member between at least one electrode frame member and the membrane unit, said membrane unit comprising at least one sheet of a hydraulically impermeable cation exchange membrane comprised of fluorocarbon polymers having a plurality of pendant groups selected from the group consisting of sulfonic acid groups, carboxylic acid groups, and mixtures thereof, said membrane material adapted for producing an alkali metal hydroxide and a halogen by electrolysis of an alkali metal halide, and at least one non-gasket, non-supporting frame reinforcement means for strengthening the gasket-bearing surface portion of the membrane such that tearing or shear stresses on the gasket-bearing surface portion of the membrane is minimized when the gasket-bearing surface portion of the membrane is under a compressive force, said reinforcement means positioned only along the gasket-bearing surface portion of the membrane on at least one side of the membrane;

(c) compressing the electrode frame members, membrane unit and gasket member with a compressive force;

(d) feeding an aqueous alkali metal halide solution to the anode compartment; and (e) passing an electrical current from the anode to the cathode such that a halide is evolved at the anode.

20. An ion exchange membrane unit for an electrolyzer of the filter press-type comprising:

(a) at least one sheet of an ion exchange membrane having a gasket-bearing surface portion and an active surface portion; and (b) at least one non-gasket non-supporting frame reinforcement means for strengthening the gasket-bearing surface portion of the membrane such that tearing or shear stresses on the gasket-bearing surface portion of the membrane is minimized when the gasket-bearing surface portion of the membrane is under a compressive force, said reinforcement means positioned only along the gasket-bearing surface portion of the membrane on at least one side of the membrane.

21. An electrolytic cell assembly of the filter press type adapted for producing an alkali metal hydroxide and a halogen by electrolysis of an alkali metal halide comprising:

(a) at least two electrode frame members, (b) at least one membrane unit interposed between the two adjacent electrode frame members separating at least two electrode compartments, and (c) at least one gasket interposed between the membrane unit and one electrode frame member, said membrane unit comprising at least one sheet of an ion exchange membrane, said membrane material adapted for producing an alkali metal hydroxide and a halogen by electrolysis of an alkali metal halide, said ion exchange membrane having a gasket-bearing surface portion and an active surface portion; and at least one non-gasket, non-supporting frame reinforcement means for strengthening the gasket-bearing surface portion of the membrane such that tearing or shear stresses on the gasket-bearing surface portion of the membrane is minimized when the gasket-bearing surface portion of the membrane is under a compressive force, said reinforcement means positioned only along the gasket-bearing surface portion of the membrane on at least one side of the membrane.

22. A method of sealing an electrolytic cell adapted for producing an alkali metal hydroxide and a halogen by electrolysis of an alkali metal halide comprising:

(a) interposing at least one membrane unit between at least two adjacent electrode frame members of the electrolytic cell;

(b) interposing at least one gasket member between at least one electrode frame member and a membrane unit of the electrolytic cell, said membrane unit comprising at least one sheet of an ion exchange membrane, said membrane material adapted for producing an alkali metal hydroxide and a halogen by electrolysis of an alkali metal halide, and at least one non-gasket, non-supporting frame reinforcement means for strengthening the gasket-bearing surface portion of the membrane such that tearing or shear stresses on the gasket-bearing surface portion of the membrane is minimized when the gasket-bearing surface portion of the membrane is under a compressive force, said reinforcement means positioned only along the gasket-bearing surface portion of the membrane on at least one side of the membrane; and (c) applying a compressive force to the electrolytic cell via the electrode frame members.

23. A method of electrolyzing an alkali metal salt to form an alkali metal hydroxide and a halogen comprising:

(a) interposing at least one membrane unit between at least a cathode frame member having a cathode and at least an anode frame member having an anode forming a catholyte and anolyte compartment;

(b) interposing at least one gasket member between at least one electrode frame member and the membrane unit, said membrane unit comprising at least one sheet of an ion exchange membrane, said membrane material adapted for producing an alkali metal hydroxide and a halogen by electrolysis of an alkali metal halide, and at least one non-gasket, non-supporting frame reinforcement means for strengthening the gasket-bearing surface portion of the membrane such that tearing or shear stresses on the gasket-bearing surface portion of the membrane is minimized when the gasket-bearing surface portion of the membrane is under a compressive force, said reinforcement means positioned only along the gasket-bearing surface portion of the membrane on at least one side of the membrane;

(c) compressing the electrode frame members, membrane unit and gasket member with a compressive force;

(d) feeding an aqueous alkali metal halide solution to the anode compartment; and (e) passing an electrical current from the anode to the cathode such that a halide is evolved at the anode.

* * * * *